United States Patent [19]

Lee

[11] 4,157,877

[45] Jun. 12, 1979

[54] APPARATUS FOR COMPACTING SUBGRADE AND PAVEMENT MATERIALS

[75] Inventor: Billy R. Lee, Newton, N.C.

[73] Assignee: B.R. Lee Industries, Inc., Charlotte, N.C.

[21] Appl. No.: 893,031

[22] Filed: Apr. 3, 1978

[51] Int. Cl.[2] ..... E01C 19/26

[52] U.S. Cl. ..... 404/128; 180/20; 299/40; 172/395; 172/518; 172/580; 280/43; 404/132

[58] Field of Search ..... 404/128, 85, 86, 132, 404/122, 125, 126; 299/40; 180/79, 20, 21, 135; 280/43; 172/310, 395, 407, 518, 580

[56] References Cited

U.S. PATENT DOCUMENTS

| | | | |
|---|---|---|---|
| 2,154,720 | 4/1939 | Biles | 404/118 X |
| 2,270,390 | 1/1942 | Summers | 404/126 |
| 2,721,405 | 10/1955 | Gardner | 404/126 X |
| 2,830,511 | 4/1958 | Wills | 404/86 |
| 2,978,967 | 4/1961 | MacDonald | 404/125 |
| 3,228,312 | 1/1966 | Neidhardt | 404/125 |
| 3,229,602 | 1/1966 | Vivier | 404/126 |
| 3,340,782 | 9/1967 | Novak | 404/128 |
| 3,477,535 | 11/1969 | Wyatt | 404/112 X |
| 3,665,822 | 5/1972 | Speer | 404/130 |

FOREIGN PATENT DOCUMENTS 1071629 6/1967 United Kingdom.

*Primary Examiner*—Nile C. Byers, Jr.
*Attorney, Agent, or Firm*—Bell, Seltzer, Park & Gibson

[57] ABSTRACT

An apparatus for compacting subgrade and pavement materials during a road building operation, and which is characterized by the ability to selectively perform a plurality of distinct road rolling functions to thereby facilitate a road building operation. The apparatus is self-propelled and includes compacting means which comprises a pair of steel cylindrical rollers and two sets of rubber wheels having overlapping tracks. Provision is made for selectively moving the sets of rubber wheels into and out of operative engagement with the ground, whereby selective compaction by the independent operation of either the steel cylindrical rollers or the rubber wheels may be effected, and without simultaneous operation by the non-operating compacting means. A unitary steering system is also provided whereby the direction of the apparatus may be controlled when either compacting means is in operation.

28 Claims, 6 Drawing Figures

APPARATUS FOR COMPACTING SUBGRADE AND PAVEMENT MATERIALS

The present invention relates to an apparatus for compacting subgrade and pavement materials in the process of paving or constructing roadbeds, pavement, or other surfaces. More specifically, the invention relates to a self-propelled apparatus adapated to selectively perform a plurality of distinct road rolling functions, including fill compaction of subgrade materials, leveling of subgrade materials, compaction and leveling of pavement materials, and kneading and sealing compaction of pavement materials, by operation of compacting means of either a pair of steel cylindrical rollers or two sets of rubber wheels having overlapping tracks, and without simultaneous operation by the non-operating compacting means.

During a road building operation, it is common practice to initially compact the subgrade material, such as gravel, with a rubber wheeled compactor, and then, to level the subgrade with a second compactor having steel rollers. After the paving material, such as asphalt is applied, the paving material is initially compacted and leveled with the steel roller compactor, and subsequently, kneaded and sealed by the use of the rubber wheeled compactor.

As will be apparent, the above road building operation requires that the two compacting machines be interchanged at least twice. Logistically, this presents difficulties since the machines may be in use at disparate locations in a construction site. Furthermore, since paving materials remain malleable only for a definite period, the operation of kneading and sealing the material requires timely application, which may not be possible if one of the two required compactors is not immediately available for use. Also, if the project is not large in scope, the required use of two separate compacting machines will represent a substantial monetary investment, which may not be economically justifiable.

Compactors with one steel roller and one rubber wheel assembly have been proposed in an attempt to alleviate the above problem. However, since a steel roller and a rubber wheeled roller perform two distinct function, any attempt to perform both operations simultaneously may result in a compromise in quality. For example, if a leveling operation is desired, the compaction of a narrow track that results from the action of the simultaneously applied rubber wheels will create non-uniform ridges or individual depressions at points of insufficient material or weak substructure, thereby diminishing the quality of the leveling process. Also, the fact that only one wheeled assembly is being used requires an additional number of passes to cover the full paving area. This requires more time and could also result in overcompaction by the steel rollers.

In addition, compactors that simultaneously apply a steel roller and rubber wheels do not permit the performance of operations between the two distinct compacting functions. For example, it is often necessary to wet the subgrade material with water after compaction with the rubber wheels, but before leveling with the steel rollers. This intermediate operation is performed by a water truck that sprinkles water on the subgrade. If the compactor simultaneously applies the rubber wheels and a steel roller to the subgrade materials, the wetting operation cannot be administered in the usual fashion.

Compactors have also been proposed which include a rubber wheeled assembly and a steel roller than may be selectively moved into an operative position. Note for example the U.S. Patent to McDonald, U.S. Pat. No. 2,978,967 and British Pat. No. 1,071,629. Here again however, these compactors only permit compaction by a combination of rubber wheels and the steel roller, and individual operation of these two types of rollers is not possible.

Other known compactors are designed so that the steel cylindrical rollers can be removed and replaced with rubber wheels. This process is a manual operation that is often complex and time-consuming. Consequently, the performance of such translation is economically undesirable.

It is accordingly an object of the present invention to provide a self-propelled road rolling machine that is adapted to perform a plurality of distinct road rolling functions by compaction with either a pair of steel cylindrical rollers or two sets of rubber wheels having overlapping tracks.

It is another object of the present invention to provide a road rolling machine that carries a combination of compacting means, namely steel cylindrical rollers and rubber wheels, and which permits the operation of one compacting means without the simultaneous operation or interference of the other compacting means. In this connection, it is also an object of this invention to provide means for quickly interchanging the operative compacting means.

It is a further object of the present invention to provide a road rolling machine having a single or unitary steering system which is adapted to turn the machine when either compacting means is operative, and which further includes means for propelling the machine when either compacting means is operative.

These and other objects and advantages of the present invention are achieved in the embodiment illustrated herein by the provision of a machine which comprises a frame having a pair of hard surfaced, cylindrical rollers positioned adjacent to the ends of the frame. Each of the cylindrical rollers is mounted to the frame so that it can rotate about a transverse, horizontal axis, and the forward cylindrical roller is mounted so that it can also pivot about a vertical axis. A pair of wheel assemblies, each comprising a plurality of coaxially aligned and spaced apart resilient wheels, are mounted at the ends of the frame, and so as to permit movement of the assemblies between a non-operative position having a ground engaging elevation above that of the cylindrical rollers and an operative position having a ground engaging elevation below that of the cylindrical rollers. Means are provided for raising and lowering the wheel assemblies between their operative and non-operative positions, and means for steering and for propelling the machine are also provided.

Some of the objects and advantages of the invention having been stated, others will appear as the description proceeds, when taken in connection with the accompanying drawings, in which FIG. 1 is a perspective view of an apparatus embodying the features of the present invention, and wherein the steel rollers are in an operative position;

Figure 1:
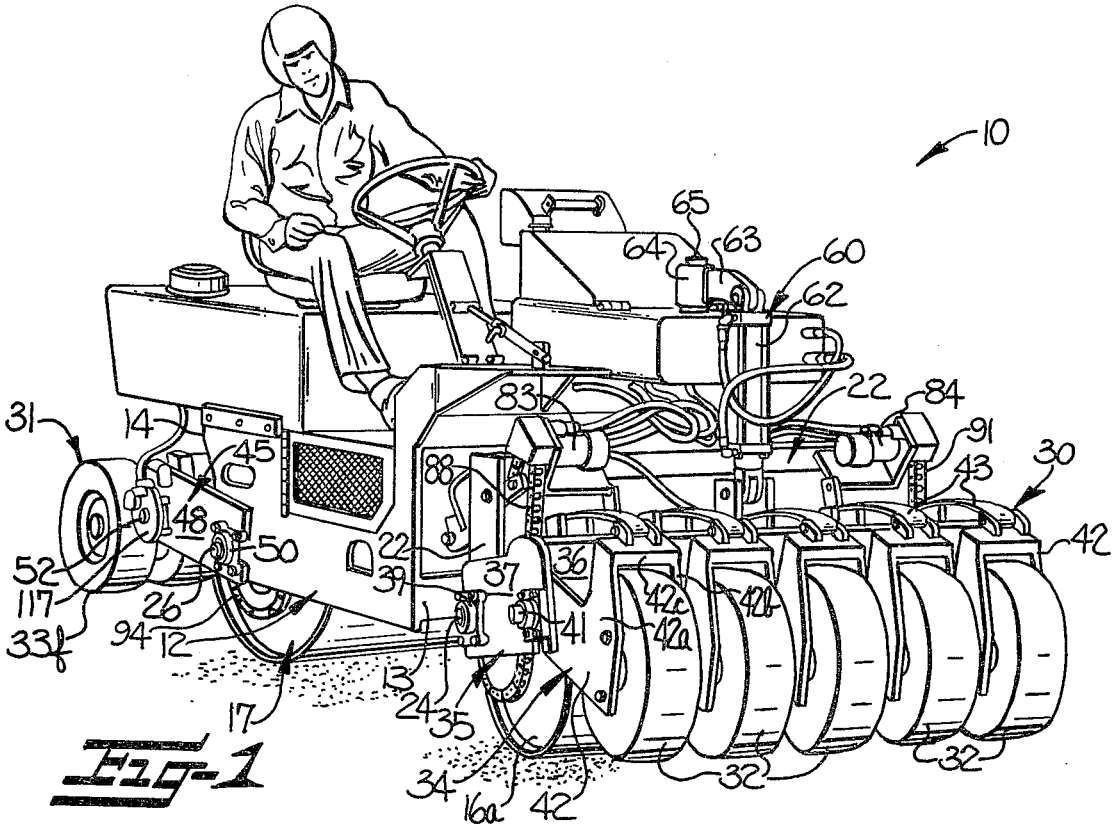

Referring more specifically to the drawings, the illustrated embodiment of the road rolling machine is indicated generally at 10, and will be seen to include a generally rectangular frame 12 having a forward end 13 and a rear end 14, at which are positioned a forward cylindrical roller 16 and a rear cylinder roller 17 respectively. The cylindrical rolles 16 and 17, which substantially correspond to the width of the frame 12, are of hollow construction so that water ballast may be added to or taken from the interior to increase or reduce the weight of the cylindrical rollers 16 and 17, thereby altering the compaction force. The exterior of the cylindrical rollers 16 and 17 is hard surfaced, preferably being constructed of steel.

More particularly, the forward cylindrical roller 16 comprises a pair of cylindrical roller segments 18 and 19 that are substantially of equal length. Means as further described below is provided for mounting the forward cylindrical roller 16 to the frame 12 whereby the roller segments 18 and 19 are in coaxial alignment and so that roller segment 18 will rotate about a transverse horizontal axis independently of the rotation of roller segment 19 about the same axis. Thereby, the roller segments 18 and 19 will differentially track when the forward cylindrical roller 16 is steered angularly with respect to the frame 12 by pivot movement about a vertical axis as hereinafter further described.

The means for mounting the forward cylindrical roller 16 includes a U-shaped support 20 having a base 21 and two parallel sides 22 and 23. Disposed between the outside ends of the roller segments 18 and 19 and their treated parallel sides 22 and 23 are bearings (not shown) that permit the roller segments 18 and 19 to rotate independently about an axle 24, and which defines a transverse horizontal axis. A T-shaped pivot pin 25 having vertical and longitudinal horizontal axes is interposed between the frame 12 and the base 21 of the U-shaped support 20. The vertical axis permits the forward cylindrical roller 16 to angularly pivot with respect to the frame 12 whereby the road rolling machine may be steered. The longitudinal horizontal axis, which is perpendicular to the vertical axis, permits the forward cylindrical roller 16 to laterally tilt with respect to the frame 12 in accordance with the slope of the surface being compacted.

Means is also provided for mounting the rear cylindrical roller 17 to the frame 12 for rotation about a transverse horizontal axis that is fixed with respect to the frame 12. This mounting means includes bearings (not shown) disposed between the outer ends of the rear cylindrical roller 17 and the sides of the frame 12, and an axle 26 extending between these bearings.

The road rolling machine 10 also includes a forward wheel assembly 30 and a rear wheel assembly 31 which are positioned at the extreme ends of the road rolling machine and outside the forward cylindrical roller 16 and the rear cylindrical roller 17 respectively. Each wheel assembly 30 and 31 comprises a plurality of coaxially aligned and spaced apart resilient wheels 32, 33, respectively, and preferably consisting of either solid rubber or pneumatic tires mounted on vehicular rims. In the illustrated embodiment, five resilient wheels 32 are provided in the forward wheel assembly 30, and six resilient wheels 33*a*–33*f* are provided in the rear wheel assembly 31. The forward wheel assembly 30 and the rear wheel assembly 31 are mounted so that the resilient wheels 32 are in a staggered relation with respect to the resilient wheels 33. This staggered relationship prevents the resilient wheels 33 from tracking the resilient wheels 32, so that the maximum surface area will be uniformly compacted.

Figure 2:
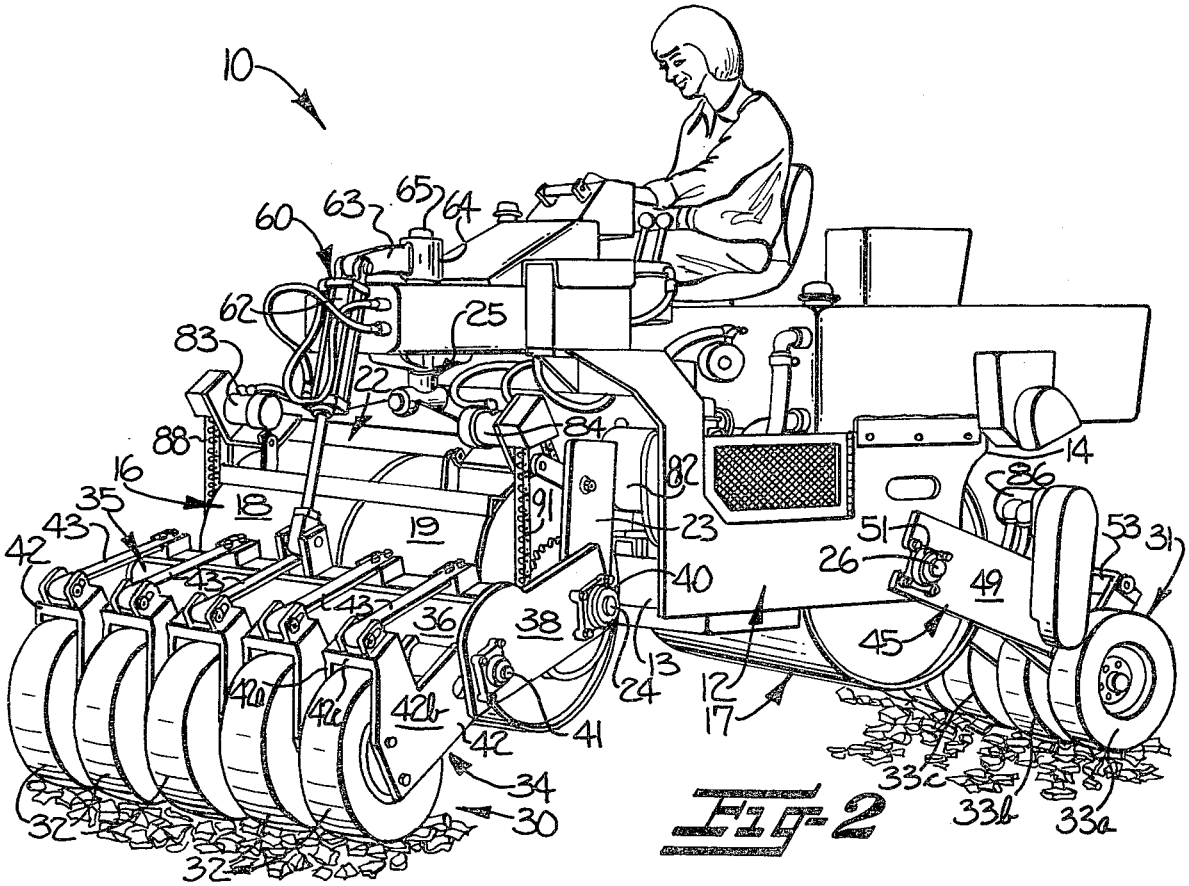
FIG. 2 is a perspective view illustrating the machine shown in FIG. 1, but with the wheel assemblies in an operative position.
Figure 3:
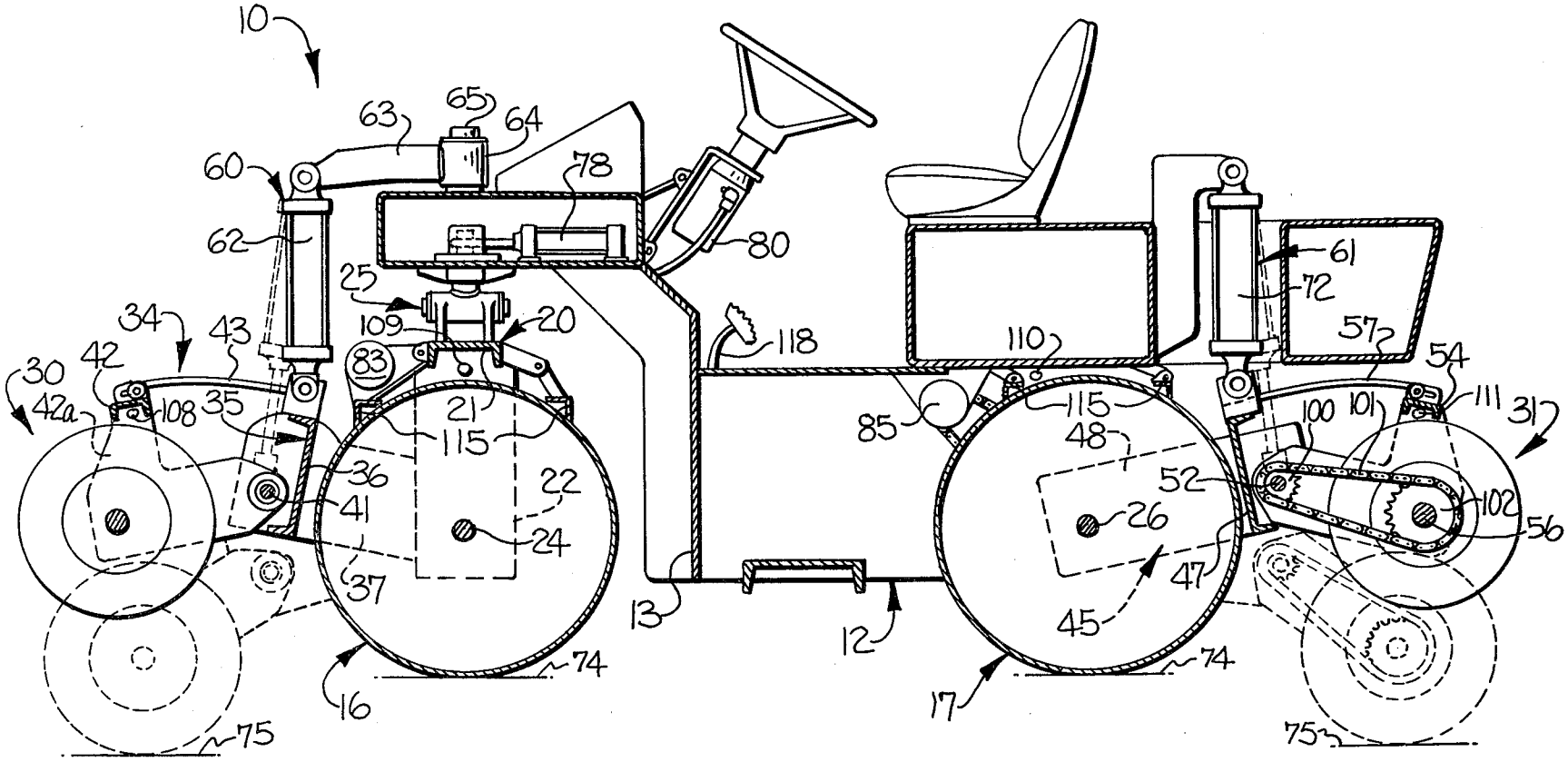
FIG. 3 is a sectional side elevation view of the machine shown in FIG. 1.

To mount the forward wheel assembly 30, there is provided a structure, generally designated as 34, which connects the forward wheel assembly 30 to the means for mounting the forward cylindrical roller 16 to the frame, and so that both the forward wheel assembly 30 and the forward cylindrical roller 16 will be concurrently pivoted about the single vertical steering axis of the pivot pin 25 for purposes of steering, as well as about the horizontal axis of the pin. As best illustrated in FIGS. 2 and 3, the structure 34 comprises a U-shaped bracket 35 having a base 36 and parallel sides 37 and 38. The bracket sides 37 and 38 are pivotally connected to the support sides 22 and 23 respectively by means of bearings 39 and 40 for pivotal movement about the axle 24 and thus the transverse horizontal axis of the forward cylindrical roller 16. A mounting shaft 41 is mounted to the bracket 35 and extends in a direction parallel to the transverse horizontal axis.

Means for mounting the resilient wheels 32 to the mounting shaft 41 is also provided, and comprises five mounting frame members 42 which are indepently and pivotally mounted to the mounting shaft 41. More particularly, each mounting frame member 42 comprises a pair of parallel side plates 42*a*, 42*b* which enclose the associated wheel and an interconnecting top plate 42*c*, with one end of the plates 42*a*, 42*b* being rotatably carried by the mounting shaft 41, and the other end supporting an axle (not numbered) for the associated wheel. Each resilient wheel 32 is provided with an individual mounting frame member 42 so that independent vertical pivotal movement is permitted. Spring suspension means in the form of a leaf spring 43 extends between the top plate 42*c* of each mounting frame member 42 and the bracket base 36 so that the resilient wheels 32 are biased in a downward direction when in an operative position, and limited vertical movement of each wheel with respect to the frame is permitted. In this regard, the interconnection between the top plate 42*c* and spring 43 includes a pin slideably received in a slot (note FIG. 3), whereby the wheel may readily move for a short distance in the vertical direction without incurring a substantial biasing force from the spring.

Figure 4:
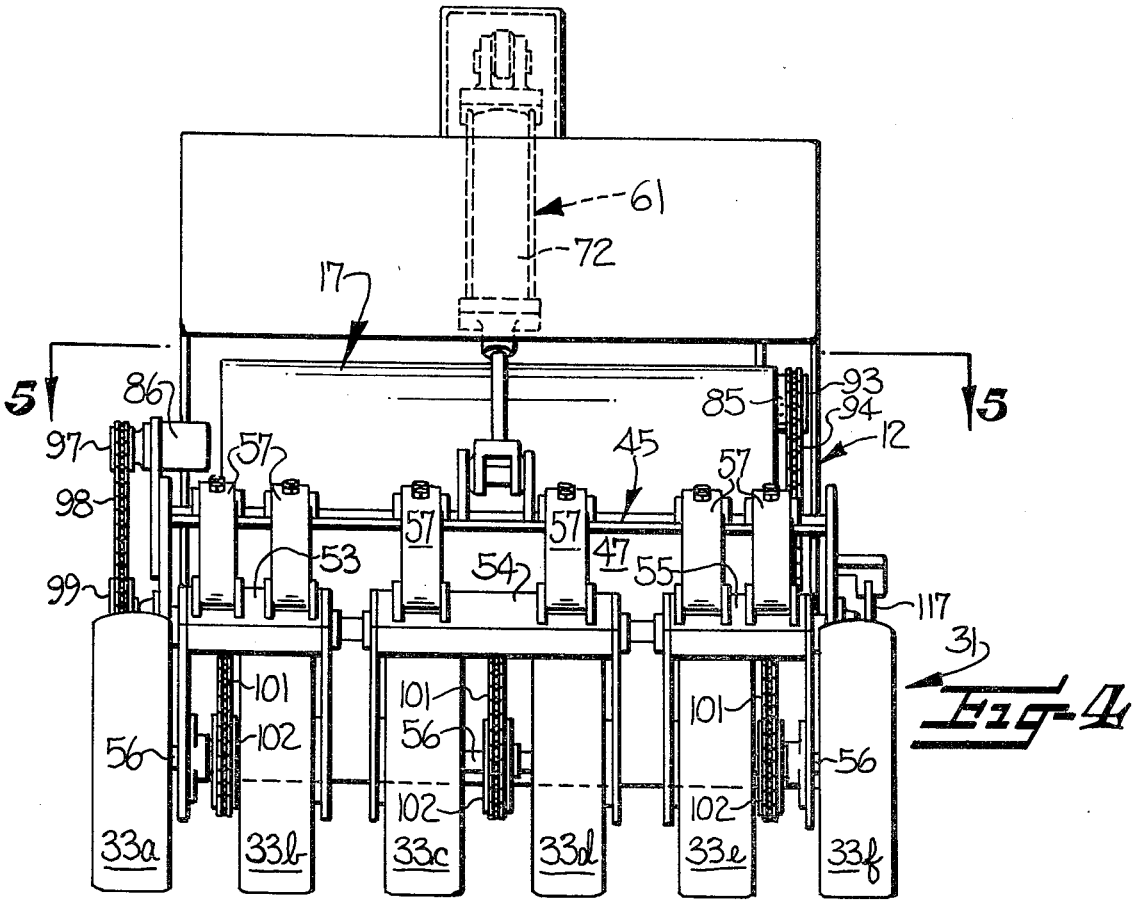
FIG. 4 is a rear elevation view of the machine shown in FIG. 1, and illustrating the rear wheel assembly.
Figure 5:
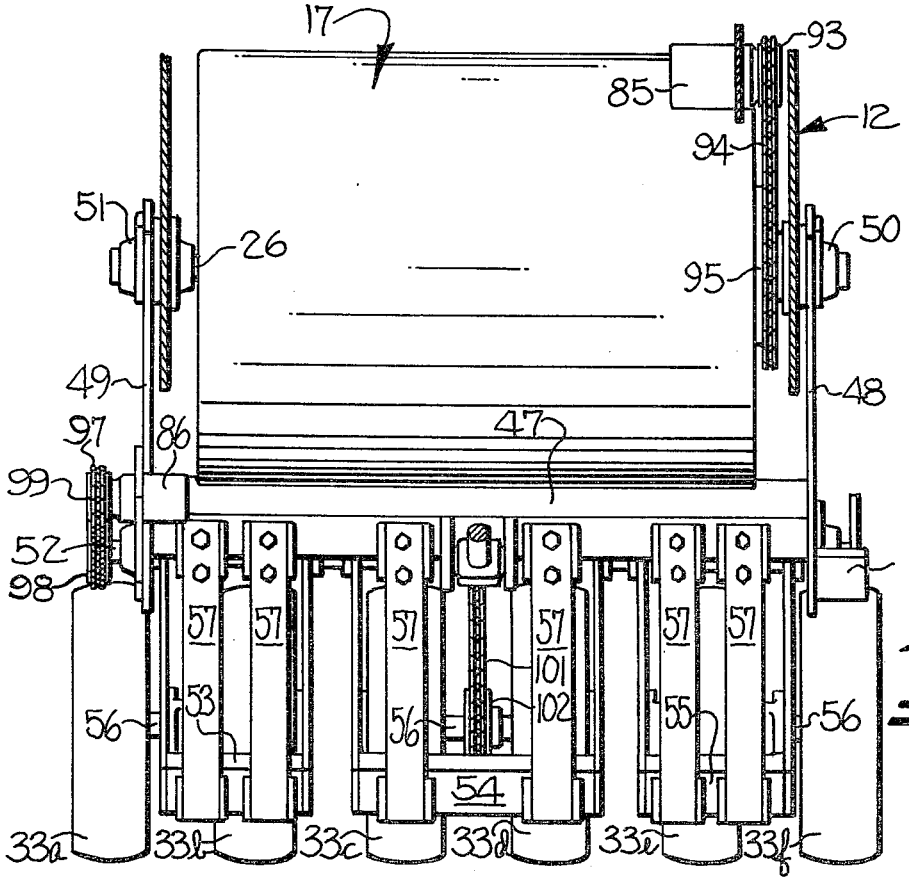
FIG. 5 is a sectional top view of the rear wheel assembly and rear cylindrical roller, and taken substantially along the line 5—5 of FIG. 4.

The rear wheel assembly 31 is similarly mounted to the frame 12 by a structure, generally designated at 45. As best illustrated in FIGS. 3, 4 and 5, the structure 45 comprises a U-shaped bracket 46 having a base 47 and parallel sides 48 and 49. The bracket sides 48 and 49 are pivotally connected to the sides of the frame 12 by means of bearings 50 and 51, for pivotal movement about the axle 26 and the fixed transverse horizontal axis of the rear cylindrical roller 17. A drive axle 52 is rotatably mounted to the bracket 46 and extends in a direction parallel to the transverse horizontal axis. To mount the resilient wheels 33 to the drive axle 52 there are provided three mounting frame members 53, 54, 55 which are pivotally mounted to the drive axle 52. In this instance, each mounting frame member 53–55 rotatably mounts a pair of wheels, and each comprises a pair of parallel side plates and an interconnecting top plate (not numbered), with each side plate having one end rotatably mounted to the drive axle, and the other end supporting an axle 56 for mounting the two associated wheels, note FIG. 4. Thus, resilient wheels 33*a* and 33*b* are mounted on frame member 53; resilient wheels 33*c* and 33*d* on frame member 54; and resilient wheels 33*e* and 33*f* on frame member 55. The resilient wheels 33 are thereby permitted to move vertically and pivotally in pairs. Spring suspension means in the form of a leaf spring 57 extends between the top plate of each associated mounting frame member and the bracket base 47, and includes a slotted interconnection as described above. The spring suspenison means 57 are mounted so that each pair of resilient wheels 33 is biased in a downward direction by a pair of spring suspension means 57 when in an operative position, while permitting limited vertical movement of each pair.

As in indicated above, each of the wheel assemblies 30 and 31 are mounted so that they can be pivoted in a vertical direction about the transverse horizontal axis of their associated cylindrical roller 16 and 17 respectively. The apparatus of the present invention also includes means for pivotally raising and lowering each wheel assembly 30 and 31, about its respective pivotal axis, and which is generally designated at 60 and 61.

Figure 6:
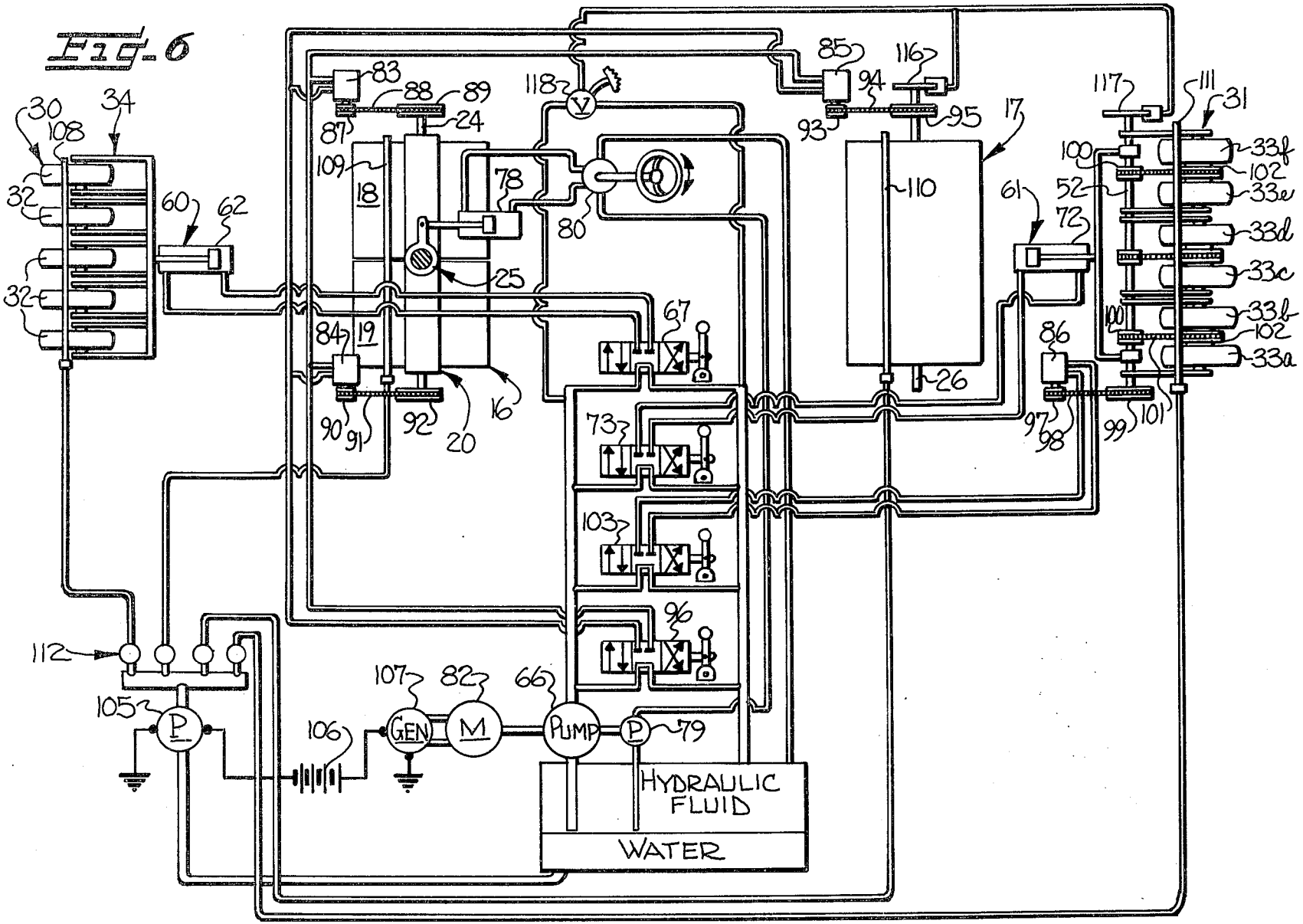
FIG. 6 is a schematic diagram of the propulsion means, steering means, means for raising and lowering the wheel assemblies, and means for wetting the cylindrical rollers and rubber wheels.

The forward raising and lowering means 60 includes a hydraulic cylinder 62 operatively connected between the frame 12 and the bracket base 21. More particularly, and as best seen in FIG. 3, the upper end of the cylinder 62 is pivotally connected to a support arm 63, and the other end of the arm 63 includes a sleeve 64 disposed about a vertical post 65 which is fixed to the frame and is aligned with the vertical axis of the pivot pin 25. By this arrangement, pivotal movement of the hydraulic cylinder 62 about the vertical steering axis is permitted. As seen in FIG. 6, pressurized hydraulic fluid is supplied to the hydraulic cylinder 62 by a hydraulic pump 66 for purposes of extending or contracting the hydraulic cylinder 62. Disposed between the hydraulic pump 66 and the hydraulic cylinder 62 is a valve 67, having a neutral position, an up position, and a down position, and which is controlled by the operator to selectively supply pressurized hydraulic fluid to the hydraulic cylinder 62.

As shown in FIGS. 1 and 3, when the valve 67 is placed in the up position, the hydraulic cylinder 62 is contracted, and the forward wheel assembly 30 is raised to a non-operative position (shown in solid lines in FIG. 3) having a ground engaging elevation above that of the forward cylindrical roller 16. With the forward wheel assembly 30 in the non-operative position, the road rolling machine 10 is operated with the forward cylindrical roller 16 in contact with the surface being compacted.

As shown in FIG. 2 and in dashed lines in FIG. 3, when the valve 67 is placed in the down position, the hydraulic cylinder 62 is extended, and the forward wheel assembly 30 is lowered to an operative position having a ground engaging elevation below that of the forward cylindrical roller 16. As the forward wheel assembly 30 is lowered to its operative position, the forward cylindrical roller 16 is raised from the surface and the road rolling machine 10 is operated with the forward wheel assembly 30 in contact with the surface being compacted.

The rear raising and lowering means 61 will be seen to be similar to that described above with respect to the forward raising and lowering means 60. Specifically, the rear raising and lowering means 61 includes a hydraulic cylinder 72 operatively connected between the frame 12 and the bracket base 47. As shown in FIG. 6, the hydraulic pump 66 supplies pressurized hydraulic fluid to the hydraulic cylinder 72 for purposes of extending or contracting the hydraulic cylinder 72. Disposed between the hydraulic pump 66 and the hydraulic cylinder 72 is a valve 73, having a neutral position, an up position, and a down position, and which selectively supplies pressurized hydraulic fluid to the hydraulic cylinder 72.

As shown in FIG. 1 and 3, when the valve 73 is placed in the up position, the hydraulic cylinder 72 is contracted, and the rear wheel assembly 31 is raised to a non-operative position (shown in solid lines in FIG. 3) having a ground engaging elevation above that of the rear cylindrical roller 17. With the rear wheel assembly 31 in the non-operative position 74, the road rolling machine 10 is operated with the rear cylindrical roller 17 in contact with the surface being compacted.

As shown in FIG. 2 and in dashed lines in FIG. 3, when the valve 73 is placed in the down position, the hydraulic cylinder 72 is extended, and the rear wheel assembly 31 is lowered to an operative position having a ground engaging elevation below that of the rear cylindrical roller 17. As the rear wheel assembly 31 is lowered to its operative position 75, the rear cylindrical roller 17 is raised from the surface and the road rolling machine 10 is operated with the rear wheel assembly 31 in contact with the surface being compacted.

The steering means for controlling the direction of the forward or backward propulsion of the road rolling machine 10 includes a hydraulic cylinder 78 operatively connected between the frame 12 and the base 21 of the support 20. As shown in FIG. 6, pressurized hydraulic fluid is supplied from a hydraulic pump 79 to the hydraulic cylinder 78 for purposes of contracting or extending the hydraulic cylinder. Disposed between the hydraulic cylinder 78 and the hydraulic pump 79 is a steering valve 80, which selectively controls the extension or contraction of the hydraulic cylinder 78. When the hydraulic cylinder 78 is extended or contracted, the support 20 is pivoted about the vertical axis of the pin 25, thereby pivoting about a single vertical axis the forward cylindrical roller 16 and simultaneously the forward wheel assembly 30. In this manner, the direction of the forward or backward propulsion of the road rolling machine 10 can be controlled when the forward wheel assembly 30 is in either its non-operative position or its operative position.

The forward and backward propulsion is imparted to the road rolling machine 10 by a prime mover 82 that is selectively coupled to the cylindrical rollers 16 and 17 and the rear wheel assembly 31 by a power transmission means. More particularly, the prime mover 82, which typically comprises an internal combustion engine, drives the hydraulic pumps 66 and 79 as described above, and the pump 66 also supplies pressurized hydraulic fluid to reversible hydraulic motors 83, 84, 85 and 86, note FIG. 6.

When it is desirable to rotate the cylindrical rollers 16 and 17 about their transverse horizontal axes, as when the wheel assemblies 30 and 31 are in their non-operative positions and the road rolling machine 10 is being propelled in either direction, pressurized hydraulic fluid is selectively supplied to the hydraulic motors 83 and 84, which are mounted to the opposite ends of the support base 21, and the hydraulic motor 85 which is mounted to the frame 12.

Drive sprocket 87, which is rotated by the hydraulic motor 83, engages a drive chain 88 for purposes of imparting torque to the sprocket 89, which in turn is mounted to the axle 24 so that the cylindrical roller segment 18 is rotated when the motor 83 is operated. In a similar manner, cylindrical roller segment 19 is driven by hydraulic motor 84, by means of drive sprocket 90, drive chain 91, and sprocket 92 mounted to axle 24, and cylindrical roller 17 is driven by hydraulic motor 85, by means of drive sprocket 93, drive chain 94, and sprocket 95 mounted to axle 26.

Disposed between the hydraulic motors 83–85 and the hydraulic pump 66 is a valve 96, having a neutral position, a forward position, and a reverse position. If the valve 96 is placed in the forward position, pressurized hydraulic fluid is delivered to the hydraulic motors 83–85 so that the hydraulic motors 83–85 rotate the cylindrical roller segments 18 and 19 and the rear cylindrical roller 17 to propel the road rolling machine 10 in a forward direction. If the valve 96 is placed in the reverse position, the flow of the pressurized hydraulic fluid through the hydraulic motors 83–85 is reversed, and the hydraulic motors 83–85 rotate in an opposite direction so that the cylindrical roller segments 18 and 19 and the rear cylindrical roller 17 propel the road rolling machine 10 in a backward direction. While three motors 83–85 are employed in the illustrated embodiment, the machine may in most instances, be driven by a single motor which drives the rear cylindrical roller 17, in which case the motors 83 and 84 would be eliminated.

When the wheel assemblies 30 and 31 are placed in their operative positions, propulsion of the road rolling machine 10 is provided in a similar manner by the rotation of the resilient wheels 33. The hydraulic motor 86, which is mounted to the parallel side 48 of the bracket 46, is equipped with a drive sprocket 97 that engages a drive chain 98. The drive chain 98 also engages a sprocket 99 that is mounted to the end of the drive axle 52 for purposes of imparting torque thereto. Along the drive axle 52 are axle sprockets 100 that engage drive axle chains 101. The drive axle chains 101 in turn engage sprockets 102, which are fixed to the axles 56 that mount each pair of resilient wheels 33. Thus, as the hydraulic motor 86 rotates, torque is imparted to the resilient wheels 33.

Disposed between the hydraulic motor 86 and the hydraulic pump 66 is a valve 103, having a neutral position, a forward position, and a reverse position, for purposes of selectively controlling the delivery of pressurized hydraulic fluid to the hydraulic motor 86. If the valve 103 is placed in the forward position, pressurized hydraulic fluid is delivered to the hydraulic motor 86 so that the hydraulic motor 86 rotates the resilient wheels 33 to propel the road rolling machine 10 in a forward direction. If the valve 103 is placed in the reverse position, the flow of the pressurized hydraulic fluid through the hydraulic motor 86 is reversed, and hydraulic motor 86 rotates in the opposite direction so that the resilient wheels 33 propel the road rolling machine 10 in a backward direction.

As illustrated schematically in FIG. 6, a system for wetting the cylindrical rollers 16 and 17 and the resilient wheels 32–33 is also provided. An electrical water pump 105, which is powered by a battery 106 and a generator 107 coupled to the prime mover 82, selectively supplies water to the watering means 108, 109, 110, and 111. The watering means 108–111 comprise essentially transversely mounted tubes capped at one end and perforated above the cylindrical rollers 16 and 17 or resilient wheels 32–33. Control valves 112 are disposed between the watering means 108–111 and the water pump 105 to permit the operator to selectively control the distribution of the water.

Spring biased scrapers 115 are mounted transversely along the cylindrical rollers 16 and 17 for purposes of removing surface materials that adhere to the cylindrical rollers 16 and 17.

Braking means is also provided and includes hydraulic disc brakes 116 and 117 that are mounted to the frame 12 at the rear end of the machine and to the drive axles 26 and 52 respectively. Pressurized hydraulic fluid is selectively supplied to the disc brakes 116 and 117 by the hydraulic pump 66. A foot operated brake valve 118, disposed between the disc brakes 116 and 117 and the hydraulic pump 66, allows the selective application of the disc brakes as desired.

In operation, it is preferable for most road building operations that the road rolling machine 10 operate with either both cylindrical rollers 16 and 17 or both wheel assemblies 30 and 31, so that uniform and efficient compaction will be provided. Thus, the operator selects the desired compacting means and either places the wheel assemblies 30 and 31 in their non-operative positions or in their operative positions by valves 67 and 73. Depending on the compacting means in operation, motion is then imparted to the road rolling machine 10 by valve 96 or valve 103. Valves 96 and 103 also permit the operator to control the forward and reverse motion as well as the rate of travel of the road rolling machine 10. The sterring valve 80 controls the direction of travel, and the brake valve 118 can be used to retard or halt the rate of travel.

In the drawings and specification, there has been set forth a preferred embodiment of the invention and although specific terms are employed, they are used in a generic and descriptive sense only and not for purposes of limitation.

That which is claimed is:

1. A self-propelled road rolling machine for compacting subgrade and pavement materials, characterized by the ability to selectively perform a plurality of distinct road rolling functions, including leveling the underlying material to obtain a smooth surface, or kneading and sealing the underlying material, to thereby facilitate a road building operation, and comprising a frame;

a pair of hard surfaced cylindrical rollers;

means mounting one of said cylindrical rollers to said frame adjacent one end thereof and for rotation about a transverse, horizontal axis and for pivotal movement about a vertical axis;

means mounting the other of said cylindrical rollers to said frame adjacent the other end thereof and for rotation about a transverse, horizontal axis;

a pair of wheel assemblies each comprising a plurality of coaxially aligned and spaced apart resilient wheels;

means mounting one of said wheel assemblies to said frame adjacent said one end thereof for movement between a first non-operative position having a ground engaging elevation above that of said one cylindrical roller, and a second operative position having a ground engaging elevation below that of said one cylindrical roller, and for pivotal movement about a vertical axis;

means mounting the other of said wheel assemblies to said frame adjacent said other end thereof and for movement between a first non-operative position having a ground engaging elevation above that of said other cylindrical roller, and a second operative position having a ground engaging elevation below that of said other cylindrical roller;

means operatively related to said wheel assembly mounting means for raising and lowering each of said wheel assemblies so that each wheel assembly can be selectively raised to its first position and lowered to its second position;

steering means mounted on said frame for selectively pivoting said one cylindrical roller and said one wheel assembly about its associated vertical axis;

a prime mover mounted to the frame; and power transmission means mounted on said frame for selectively coupling the prime mover to at least one of said cylindrical rollers and to at least one of said resilient wheels, to thereby propel the machine.

2. A self-propelled road rolling machine as defined in claim 1 wherein said one wheel assembly is positioned at the extremity of said one end of said machine, and said other wheel assembly is positioned at the extremity of said other end of said machine, and such that the wheel assemblies are positioned outside the cylindrical rollers.

3. A self-propelled road rolling machine as defined in claim 1 wherein said means for raising and lowering each of said wheel assemblies comprises a pair of fluid actuated cylinders each operatively connected to the frame and its associated wheel assembly, and pump means mounted on said frame for selectively supplying pressurized fluid to said cylinders.

4. A self-propelled road rolling machine as defined in claim 1 wherein said steering means comprises at least one fluid actuated cylinder operatively connected to said frame, said one cylindrical roller, and said one wheel assembly; and pump means mounted on said frame for selectively suppling pressurized fluid to said cylinder.

5. A self-propelled road rolling machine as defined in claim 1 wherein said power transmission means comprises at least two reversible hydraulic motors, one of said hydraulic motors being operatively connected to at least one of said cylindrical rollers and another of said hydraulic motors being operatively connected to at least one of said plurality of resilient wheels; and hydraulic pump means for selectively supplying pressurized hydraulic fluid to said hydraulic motors.

6. A self-propelled road rolling machine as defined in claim 5 wherein the wheels on said one wheel assembly are in staggered relation with respect to the wheels on said other wheel assembly, so that the wheels of the two assemblies do not track.

7. A self-propelled road rolling machine for compacting subgrade and pavement materials, characterized by the ability to selectively perform a plurality of distinct road rolling functions, including leveling the underlying material to obtain a smooth surface, or kneading and sealing the underlying material, to thereby facilitate a road building operation, and comprising a frame;

a pair of hard surfaced cylindrical rollers, each having an axial length which substantially corresponds to the width of said frame;

means mounting one of said cylindrical rollers to said frame adjacent one end thereof for rotation about a transverse, horizontal axis and for pivotal movement about a vertical axis which is fixed with respect to said frame;

means mounting the other of said cylindrical rollers to said frame adjacent the other end thereof and for rotation about a transverse, horizontal axis which is fixed with respect to said frame;

a pair of wheel assemblies each comprising a plurality of coaxially aligned and spaced apart resilient wheels;

means mounting one of said wheel assemblies to said means mounting said one cylindrical roller, and on the outer side of said one cylindrical roller, and for pivotal movement about the horizontal rotational axis of said one cylindrical roller and between a first non-operative position having a ground engaging elevation above that of said one cylindrical roller, and a second operative position having a ground engaging elevation below that of said one cylindrical roller, and whereby said one wheel assembly pivots with said one cylindrical roller about said vertical axis;

means mounting the other of said wheel assemblies to said frame on the outer side of said other cylindrical roller and for pivotal movement about said fixed horizontal rotational axis and between a first non-operative position having a ground engaging elevation above that of said other cylindrical roller, and a second operative position having a ground engaging elevation below that of said other cylindrical roller;

means operatively related to said wheel assembly mounting means for pivoting each of said wheel assemblies about its respective horizontal pivotal axis so that each wheel assembly can be selectively raised to its first position and lowered to its second position;

steering means mounted on said frame for concurrently pivoting said one cylindrical roller and said one wheel assembly about said vertical axis;

a prime mover mounted to said frame; and power transmission means mounted on said frame for selectively coupling said prime mover to at least one of said cylindrical rollers and to at least a plurality of said resilient wheels, to thereby propel the machine.

8. A self-propelled road rolling machine as defined in claim 7 wherein said means mounting said one cylindrical roller further comprises a U-shaped support having a base and two parallel sides, bearing means rotatably mounting said one cylindrical roller between said two sides for rotation about said transverse horizontal axis, and pivot pin means interposed between said frame and medial portion of said support base and including a rotational axis corresponding to said vertical axis.

9. A self-propelled road rolling machine as defined in claim 8 wherein said pivot pin means further includes a second rotational axis disposed in a horizontal, longitudinal direction, and such that said pivot pin means permits said one cylindrical roller and said one wheel assembly to laterally tilt with respect to said frame.

10. A self-propelled road rolling machine as defined in claim 8 wherein said means mounting said one wheel assembly further comprises a U-shaped first bracket having a base and parallel sides, and with said first bracket sides being pivotally connected to said support sides for relative pivotal movement about said transverse horizontal axis of said one cylindrical roller, a mounting shaft mounted to said U-shaped first bracket and disposed parallel to said transverse horizontal axis, and means mounting each of the wheels of said one wheel assembly for pivotal movement about said mounting shaft.

11. A self-propelled road rolling machine as defined in claim 10 wherein said means mounting each of the wheels of said one wheel assembly comprises a mounting frame member operatively associated with each wheel of said one wheel assembly, with each mounting frame member having one portion thereof pivotally mounted to said mounting shaft and another portion thereof rotatably mounting the associated wheel, and spring suspension means extending between each of said mounting frame members and said base of said first bracket for permitting limited and independent vertical movement of each wheel with respect to the frame of said machine.

12. A self-propelled road rolling machine as defined in claim 11 wherein said means mounting said other wheel assembly comprises a U-shaped second bracket having a base and parallel sides, and with said second bracket sides being pivotally connected to said frame for relative pivotal movement about said fixed transverse horizontal axis, a drive axle rotatably mounted to said U-shaped second bracket and disposed parallel to said fixed transverse horizontal axis, and means mounting each of the wheels of said other wheel assembly for pivotal movement about said drive axle.

13. A self-propelled road rolling machine as defined in claim 12 wherein said means mounting each of the wheels of said other wheel assembly comprises a mounting frame member operatively associated with no more than two of the wheels of said other wheel assembly, with each such mounting frame member having one portion thereof pivotally mounted to said drive axle and another portion rotatably mounting the associated wheels, and spring suspension means extending between each of said mounting frame members and base of said second bracket for permitting limited vertical movement of the wheels of the other wheel assembly with respect to the frame of said machine.

14. A self-propelled road rolling machine as defined in claim 13 wherein said power transmission means comprises hydraulic pump means mounted on said frame adapted to selectively supply pressurized hydraulic fluid, means operatively coupling said prime mover to said hydraulic pump means, at least two reversible hydraulic motors, with one of said hydraulic motors being operatively connected to said drive axle, and the other of said hydraulic motors being operatively connected to at least one of said cylindrical rollers, means selectively transmitting the pressurized hydraulic fluid from said pump means to said hydraulic motors, and means transmitting the axial rotation of said drive axle to at least a plurality of the wheels of said other wheel assembly.

15. A self-propelled road rolling machine as defined in claim 14 wherein said means for pivotally raising and lowering each of said wheel assemblies comprises a pair of hydraulic cylinders, with one of said cylinders being operatively connected between said frame and said base of said first bracket, and the other of said cylinders being operatively connected between said frame and said base of said second bracket, and means selectively transmitting the pressurized hydraulic fluid from said pump means to said hydraulic cylinders.

16. A self-propelled road rolling machine as defined in claim 15 wherein said steering means comprises at least one hydraulic steering cylinder operatively connected between said frame and said pivot pin means and adapted to selectively rotate said U-shaped support about said vertical axis, and means selectively transmitting the pressurized fluid from said pump to said steering cylinder.

17. A self-propelled road rolling machine as defined in claim 16 wherein said one cylindrical roller comprises a pair of hard surfaced, cylindrical roller segments of substantially equal axial length and mounted in coaxial alignment so that said one cylindrical roller will differentially track when steered angularly with respect to said frame by rotation about said vertical axis.

18. A self propelled road rolling machine for compacting subgrade and pavement material, characterized by the ability to selectively perform a plurality of distinct road rolling functions, including leveling the underlying material to obtain a smooth surface, or kneading and sealing the underlying material, to thereby facilitate a road building operation, and comprising a frame;

a hard surfaced cylindrical roller;

means mounting said cylindrical roller to said frame and comprising a U-shaped roller support having a base and two parallel sides, bearing means rotatably mounting said roller between said two sides and for rotation about a transverse horizontal axis, and pivot pin means positioned between said frame and the medial portion of said support base for permitting relative rotation between said frame and roller support about a vertical steering axis;

a wheel assembly comprising a plurality of coaxially aligned and spaced apart resilient wheels;

means mounting said wheel assembly to said roller support and for pivotal movement about a horizontal pivotal axis parallel to said rotational axis of said cylindrical roller and between a first non-operative position having a ground engaging elevation above that of said cylindrical roller and a second operative position having a ground engaging elevation below that of said cylindrical roller, and whereby said wheel assembly pivots with said cylindrical roller about said vertical axis;

means operatively related to said wheel assembly mounting means for pivoting said wheel assembly about said horizontal pivotal axis so that the wheel assembly can be selectively raised to its first position and lowered to its second position;

steering means operatively connected between said frame and said pivot pin means for concurrently pivoting said cylindrical roller and said wheel assembly about said vertical steering axis; and means mounted to said frame for propelling the machine along the ground.

19. A self-propelled road rolling machine as defined in claim 18 wherein said means mounting said wheel assembly to said roller support comprises a U-shaped bracket having a base and parallel sides, and with said bracket sides being pivotally connected to said support sides, and such that the pivotal axis of said bracket with respect to said support sides corresponds to said transverse horizontal axis of said cylindrical roller.

20. A self-propelled road rolling machine as defined in claim 19 wherein said means mounting said wheel assembly to said roller support further comprises a mounting shaft mounted to said U-shaped bracket and disposed parallel to said transverse horizontal axis, a plurality of mounting frame members pivotally mounted to said shaft, with each mounting frame member rotatably mounting at least one of said wheels, and spring suspension means extending between each of said mounting frame members and said base of said U-shaped bracket for permitting limited vertical movement of the wheels with respect to the frame of said machine.

21. A self-propelled road rolling machine as defined in claim 20 wherein said pivoting means comprises a hydraulic cylinder having one end mounted to said frame for pivotal movement about said vertical steering axis and the other end pivotally connected to said base of said bracket.

22. A self-propelled road rolling machine as defined in claim 21 wherein said pivot pins means comprises a T-shaped pivot pin having a first rotational axis corresponding to said vertical steering axis, and a second rotational axis disposed perpendicular to said steering axis and in a horizontal, longitudinal direction to permit said roller and wheel assembly to laterally tilt with respect to said frame.

23. A self-propelled road rolling machine for compacting subgrade and pavement material, characterized by the ability to selectively perform a plurality of distinct road rolling functions, including leveling the underlying material to obtain a smooth surface, or kneading and sealing the underlying material, to thereby facilitate a road building operation, and comprising a frame;

a hard surfaced cylindrical roller;

means mounting said cylindrical roller to said frame for rotation about a transverse, horizontal axis which is fixed with respect to said frame;

a wheel assembly comprising a plurality of coaxially aligned and spaced apart resilient wheels;

means mounting said wheel assembly to said frame and for pivotal movement about a horizontal pivotal axis parallel to said fixed rotational axis of said cylindrical roller and between a first non-operative position having a ground engaging elevation above that of said cylindrical roller, and a second operative position having a ground engaging elevation below that of said cylindrical roller;

means operatively related to said wheel assembly mounting means for pivoting said wheel assembly about said pivotal axis so that the wheel assembly can be selectively raised to its first position and lowered to its second position; and means mounted to said frame for propelling the machine along the ground.

24. A self-propelled road rolling machine as defined in claim 23 wherein said means for mounting said wheel assembly to said frame comprises a U-shaped bracket having a base and parallel sides, and with said bracket sides being pivotally connected to said frame, and such that the pivotal axis of said bracket with respect to said frame corresponds to said fixed transverse horizontal axis of said cylindrical roller.

25. A self-propelled road rolling machine as defined in claim 24 wherein said pivoting means comprises a hydraulic cylinder having one end mounted to said frame and the other end connected to said base of said bracket.

26. A self-propelled road rolling machine as defined in claim 25 wherein said propelling means comprises a prime mover mounted on said frame, and power transmission means mounted on said frame selectively coupling the prime mover to said cylindrical roller and at least one of said resilient wheels.

27. A self-propelled road rolling machine as defined in claim 26 wherein said means mounting said wheel assembly to said frame further comprises a drive axle rotatably mounted to said U-shaped bracket and disposed parallel to said transverse horizontal axis, a plurality of mounting frame members pivotally mounted to said shaft, with each mounting frame member rotatably mounting at least one of said wheels, and spring suspension means extending between each of said mounting frame members and said base of said U-shaped bracket for permitting limited vertical movement of the wheels with respect to the frame of said machine.

28. A self-propelled road rolling machine as defined in claim 27 wherein said power transmission means includes means for transmitting power from said prime mover to rotate said drive axle, and means for transmitting the rotation of the drive axle to at least a plurality of said resilient wheels.

* * * * *